US008524069B2

(12) United States Patent
Joseck et al.

(10) Patent No.: US 8,524,069 B2
(45) Date of Patent: Sep. 3, 2013

(54) PRODUCTION OF HIGH VISCOSITY INDEX LUBE BASE OILS

(75) Inventors: Eric D. Joseck, Burke, VA (US); Timothy Lee Hilbert, Fairfax, VA (US); Merryl J. Miranda, Falls Church, VA (US); Jeenok Theresa Kim, Fairfax, VA (US); Michael Brian Carroll, Center Valley, PA (US); Bryan E. Steuer, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 616 days.

(21) Appl. No.: 12/378,928

(22) Filed: Feb. 20, 2009

(65) Prior Publication Data

US 2009/0261015 A1 Oct. 22, 2009

Related U.S. Application Data

(60) Provisional application No. 61/067,834, filed on Feb. 29, 2008.

(51) Int. Cl.
*C10G 69/02* (2006.01)
*C10G 73/44* (2006.01)

(52) U.S. Cl.
USPC ..... 208/60; 208/27; 208/28; 208/89

(58) Field of Classification Search
USPC ..... 208/59, 60, 62, 87, 89, 96, 134, 27, 208/28, 88, 97, 57
See application file for complete search history.

(56) References Cited

U.S. PATENT DOCUMENTS

| | | | | |
|---|---|---|---|---|
| 6,231,749 | B1 * | 5/2001 | Degnan et al. | 208/27 |
| 6,974,535 | B2 * | 12/2005 | Cody et al. | 208/57 |
| 2004/0108248 | A1 | 6/2004 | Cody et al. | |
| 2004/0108249 | A1 | 6/2004 | Cody et al. | |
| 2004/0154957 | A1 | 8/2004 | Keeney et al. | |
| 2005/0040073 | A1 | 2/2005 | Cody et al. | |

FOREIGN PATENT DOCUMENTS

| | | |
|---|---|---|
| WO | 2004033590 | 4/2004 |
| WO | 2004033597 | 4/2004 |

* cited by examiner

*Primary Examiner* — Walter D Griffin
*Assistant Examiner* — Renee E Robinson
(74) *Attorney, Agent, or Firm* — Paul E. Purwin; Robert A. Migliorini

(57) ABSTRACT

The invention below shows a preferred method to make high quality base oil at unexpectedly high yields using a combination of hydrotreatment of high waxy feedstocks accompanied by hydroisomerization of the resulting wax to produce an extra high VI lube of greater than 140VI and at least −18 deg C. pour point or less. The preferred combinations of conditions identified below can surprisingly lead to unexpectedly high yields. This allows the use of higher oil content (or lower wax content) feedstocks.

8 Claims, 2 Drawing Sheets

PRODUCTION OF HIGH VISCOSITY INDEX LUBE BASE OILS

This Application claims the benefit of U.S. Provisional Application 61/067,834 filed Feb. 29, 2008.

FIELD OF THE INVENTION

This invention is directed to a process for producing high viscosity index lube base oils from waxy feeds with high oil content.

BACKGROUND OF THE INVENTION

There is an increasing demand for high quality lubricant oil basestocks for a variety of purposes. In particular, formulation of premium passenger motor vehicle lubricants, such as "0W30" and "0W40" passenger car motor oils, require the use of high viscosity index base oils that meet a variety of requirements, including high viscosity index (VI) and low pour point.

Production of high viscosity index base oil from a feedstock will typically require some type of processing, such as a hydroprocessing sequence of hydrotreatment followed by catalytic dewaxing. The severity of the processing will depend on the nature of the feedstock being processed. Processes with increased severity can be used to improve the VI of a base oil, but such increased severity also typically results in dramatic reductions in yield. Thus, practical and economic considerations limit the scope of initial feedstocks that can be used for forming high viscosity index base oils.

What is needed is a method for expanding the types of initial feedstocks that can be used for forming high viscosity index base oils.

SUMMARY OF THE INVENTION

In an embodiment, a method for producing a high viscosity base oil having a VI of at least 140 is provided. The method includes hydrotreating a feedstock containing at least 10 wt % oil in wax under effective conditions for conversion of 4-15 wt % of the feed to products boiling below 370° C., followed by catalytically dewaxing the hydrotreated feed under effective conditions to produce a base oil with a VI of at least 140 and a pour point of −18° C. or less.

In various embodiments, the method can be used to make a base oil with a viscosity of at least 4 cSt, or at least 5 cSt, or at least 6 cSt. Alternatively, the method can be used to make a base oil with a viscosity of 4 cSt or less, or 5 cSt or less, or 6 cSt or less.

In various embodiments, the method can be used to make a base oil by using hydrotreating conditions effective for converting at least 4 wt % of the feed to products boiling below 370° C., or at least 6 wt %, or at least 8 wt %, or at least 10 wt %. Alternatively, the method can be used to make a base oil by using hydrotreating conditions effective for converting 12 wt % or less of the feed to products boiling below 370° C., or 10 wt % or less.

In various embodiments, the oil in wax content of the feed can be at least 15 wt %, or at least 20 wt %, or at least 25 wt %, or at least 30 wt %.

DETAILED DESCRIPTION OF THE PREFERRED EMBODIMENTS

Figure 1:
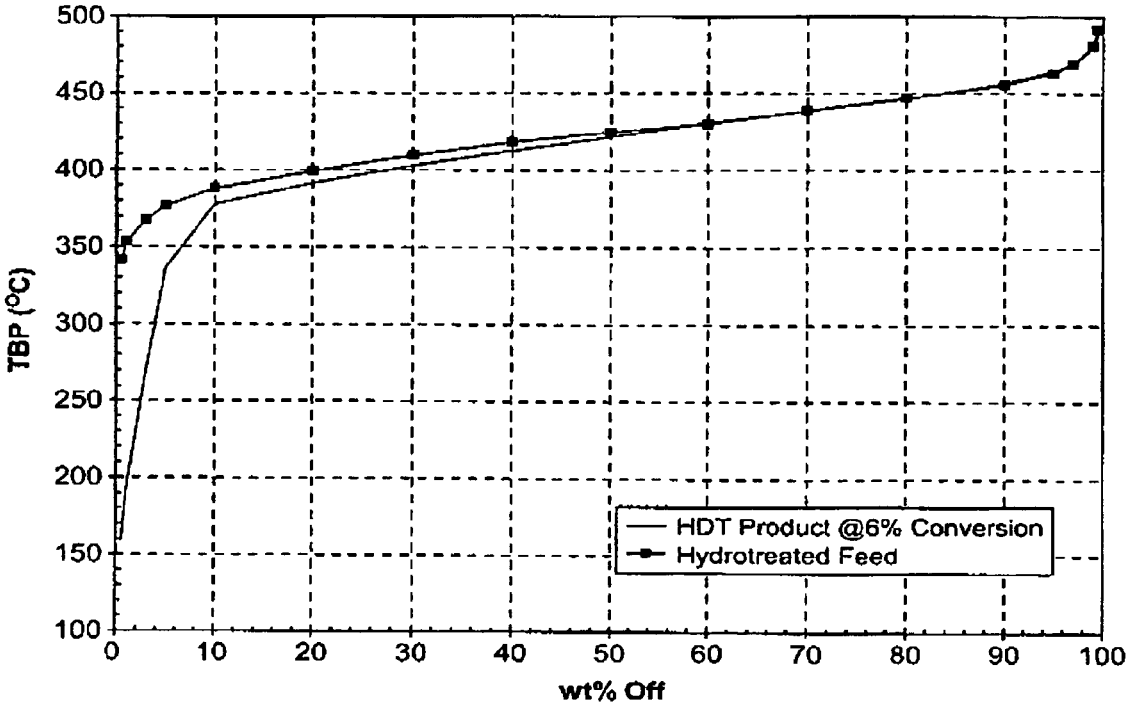
FIG. 1 shows the distillation curve for a feed before and after severe hydrotreatment.

The invention below shows a preferred method to make high quality base oil at unexpectedly high yields using a combination of hydrotreatment of high waxy feedstocks accompanied by hydroisomerization of the resulting wax to produce an extra high VI lube of greater than 140VI and at least −18 deg C. pour point or less. The preferred combinations of conditions identified below can surprisingly lead to unexpectedly high yields. This allows the use of higher oil content (or lower wax content) feedstocks.

Generally, this invention provides a process for producing high viscosity index base oils by severely hydrotreating a waxy feed with a high oil content, such as a slack wax with 15-40% oil content, to produce a base stock with a viscosity index (VI) of greater than 140. Slack waxes or wax feed stocks that contain high oil contents (>15%) can not be used to produce >140 VI products via wax isomerization by itself or even from a combination of mild hydrotreating and wax isomerization. This invention demonstrates how increasing the hydrotreating severity impacts the final lube VI and yield from the down stream wax isomerization unit. This invention also demonstrates that there is an preferred range of hydrotreating severity for improving the product VI and yield across the hydrodewaxing step. This process technology is applicable to a wide visgrade range (100N-700N) of high Oil-in-Wax (15-30%) containing slack wax as well as soft wax feeds with oil content of up to 40%, or even greater than 40%, to produce 3 to 8 cSt base oil having VI>140 and pour point lower than −18° C.

Overview

High viscosity index base oils are required to produce a variety of high quality lubricants. In particular, a base oil which meets a variety of properties, including a VI greater than 140 and a pour point of −18° C. or less, can be incorporated into high end lubricating oils, such as 0W30 or 0W40 passenger car motor oils. Such motor oils represent premium products, and are a high value use of oil. Currently, such high viscosity index base oils are produced by hydrotreating and then isomerizing slack wax feeds. The hydrotreatment step is selected to produce a hydrotreated product with less than 50 wppm of sulfur and less than 1 wppm of nitrogen. Using conventional methods, a slack wax feed with less than 10% oil in wax can be used to make a 4 cSt base oil, while heavier base oils (6 cSt) can be made using a slack wax with less than 20% oil in wax.

Various embodiments of the invention allow for effective formation of high viscosity index base oils using a broader range of feedstocks. In an embodiment, a slack wax with an oil content of greater than 10% by weight, such as at least 15% by weight, or at least 20%, or at least 25%, is severely hydrotreated at a higher conversion than required to remove organic sulfur and nitrogen. The severely hydrotreated feed is then dewaxed, and preferably hydrofinished, to produce a base oil with a VI of at least 140 and a pour point of −18 C or less. According to the invention, a range of hydrotreatment has been identified that allows for formation of base oils having a VI of greater than 140 while significantly improving the overall yield of base oil across the combination of the hydrotreatment and dewaxing steps. This increases the available feed stocks that are economically viable for production of high viscosity index base oils. In another embodiment, the invention can be used with lower oil in wax content feeds to produce base oils of even higher quality, such as VI values well above 140. Preferably, the resulting base oil corresponds to a 4 cSt base oil, or another lighter grade of base oil.

In another embodiment, a feed with an oil content of greater than 15% by weight, such as at least 20%, or at least 25%, or at least 30%, is severely hydrotreated at a higher conversion than required to remove organic sulfur and nitrogen. The severely hydrotreated feed is then dewaxed, and preferably hydrofinished, to produce a base oil (5 cSt or greater) with a VI of at least 140 and a pour point of −18 C or less. According to the invention, a range of hydrotreatment has been identified that allows for formation of base oils having a VI of greater than 140 while significantly improving the overall yield of base oil across the combination of the hydrotreatment and dewaxing steps. This increases the available feed stocks that are economically viable for production of high viscosity index base oils. In another embodiment, the invention can be used with lower oil in wax content feeds to produce base oils with even higher quality, such as VI values well above 140.

In still another embodiment, a feed with an oil content of greater than 20% by weight, such as at least 25%, or at least 30%, is severely hydrotreated at a higher conversion than required to remove organic sulfur and nitrogen. The severely hydrotreated feed is then dewaxed, and preferably hydrofinished, to produce a heavy base oil (6 cSt or greater) with a VI of at least 140 and a pour point of −18 C or less. According to the invention, a range of hydrotreatment has been identified that allows for formation of base oils having a VI of greater than 140 while significantly improving the overall yield of base oil across the combination of the hydrotreatment and dewaxing steps. This increases the available feed stocks that are economically viable for production of high viscosity index base oils. In another embodiment, the invention can be used with lower oil in wax content feeds to produce base oils with even higher quality, such as VI values well above 140.

The above processes are enabled by the unexpected discovery that certain ranges of severe hydrotreating allow for higher yields from the overall hydrotreatment process. Typically, a hydrotreatment step or a catalytic dewaxing step will result in some loss of yield across the step. Thus, producing a base oil from a feedstock using both a hydrotreatment and a catalytic dewaxing step would be expected to have yield losses across both steps.

For the hydrotreatment step, the loss of yield can be expressed in terms of "conversion" of molecules within the feed relative to a boiling point temperature. In this application, conversion will refer to the weight percent of molecules within a feed that are converted from boiling above 370° C. to below 370° C. For dewaxing, severity is measured based on the desired pour point of the finished product. Achieving a lower pour point requires an increase in severity, and typically a decrease in yield for the dewaxing step.

In the process according to the invention, a range of severe hydrotreating has been identified that leads to improved overall yields. The hydrotreatment step is characterized relative to the amount of conversion. The hydrotreatment conditions used to achieve the desired level of conversion are not critical. Instead, what is needed is the amount of conversion itself. Preferably, the amount of conversion in the hydrotreatment step should be from about 6 wt % to about 12 wt %. In an embodiment, the amount of conversion in the hydrotreatment step is at least 4 wt %, or at least 6 wt %, or at least 8 wt %. In another embodiment, the amount of conversion is 15 wt % or less, or 12 wt % or less, or 10 wt % or less.

The hydrotreated feedstock, which has undergone the amount of conversion specified, is then catalytically dewaxed. Typically, it would be expected that the yield loss from the catalytic dewaxing step would be cumulative with any yield losses due to the hydrotreatment step. However, it has been unexpectedly found that the severe hydrotreatment according to the invention allows for improved yields from the catalytic dewaxing step at a given pour point. Thus, even though the severe hydrotreatment according to the invention causes a direct loss in yield due to conversion, this yield loss is mitigated by the improved yield in the catalytic dewaxing step.

The benefits of the invention are relative to the starting feedstock used. Without being bound by any particular theory, it is believed that given a particular starting feed, the invention will provide a lubricant product with a higher percentage terminal methyl groups as compared to a process involving mild or no hydrotreatment. When processed to achieve a target VI and/or yield, the invention will provide a lubricant with an improved pour point and cloud point relative to conventional processing.

Processing according to the invention can be used to achieve two different types of benefits. For feeds with a higher oil in wax content (such as greater than 10 wt % oil in wax), the invention allows the feed to be used for efficient production of a higher value product. Normally, a feed with a higher amount of oil in wax would be used as a feed for a fuels hydrocracker, or another lower value product. The invention expands the types of feeds that can be used in creating high viscosity base oils.

The second type of benefit enabled by the invention is the ability to further enhance the low temperature properties and yields for any type of waxy feed. Thus, for feeds that are typically used to produce high viscosity base oils, the invention allows for processing of the feed to produce a base oil with an even higher combination of VI and yield at a given pour point.

Feedstock

In various embodiments, the feed stock can be a slack wax, high wax content raffinate, high wax content vacuum distillate, high wax content slack wax from solvent or propane dewaxing or deoiling, high wax content soft wax, or other high wax content feed stock with an oil content greater than 10 wt % oil in wax. Such a feed can be used to make, for example, light viscosity base oils (4 cSt). For heavier viscosity base oils (6 cSt or greater), a greater than 20 wt % oil in wax feed can be used. An example of suitable feed is shown in Table 1.

TABLE 1

| Waxy Feed Sample | Unit | Test Method | 150 Slack Wax |
|---|---|---|---|
| Density @ 60° C. | g/cm$^3$ | ASTM D-4052 | 0.7911 |
| Density @ 100° C. | g/cm$^3$ | ASTM D-4052 | 0.7658 |
| Kinematic Viscosity at 60° C. | mm$^2$/s (cSt) | ASTM D-445 | 8.112 |
| Kinematic Viscosity at 100° C. | mm$^2$/s (cSt) | ASTM D-445 | 3.761 |
| Viscosity Index | | ASTM D-2270 | 176 |
| Oil Content | wt % | ASTM D-3235 | 17 |
| Sulfur | wt % | ASTM D-2622 | 0.15 |
| Nitrogen Content | wppm | ASTM D-4629 | 21 |
| Distillation | | | |
| 0.5 wt % | ° C. | ASTM D-2887 | 341.5 |
| 5 wt % | ° C. | ASTM D-2887 | 376.5 |
| 10 wt % | ° C. | ASTM D-2887 | 387.6 |
| 20 wt % | ° C. | ASTM D-2887 | 399.1 |
| 30 wt % | ° C. | ASTM D-2887 | 409.3 |
| 40 wt % | ° C. | ASTM D-2887 | 418.2 |
| 50 wt % | ° C. | ASTM D-2887 | 424.7 |
| 60 wt % | ° C. | ASTM D-2887 | 429.8 |

TABLE 1-continued

| Waxy Feed Sample | Unit | Test Method | 150 Slack Wax |
|---|---|---|---|
| 70 wt % | ° C. | ASTM D-2887 | 438.3 |
| 80 wt % | ° C. | ASTM D-2887 | 446.8 |
| 90 wt % | ° C. | ASTM D-2887 | 455.4 |
| 95 wt % | ° C. | ASTM D-2887 | 463.0 |
| 99.5 wt % | ° C. | ASTM D-2887 | 491.6 |
| MABP | ° C. | ASTM D-2887 | 423.1 |
| Solvent Dewaxed Qualities | | | |
| Pour Point | oC | ASTM D-97 | −1 |
| KV100 | cSt | ASTM D-445 | 4.839 |
| KV40 | cSt | ASTM D-445 | 26.091 |
| VI | | ASTM D-2270 | 106.7 |

One aspect of the invention is that the feedstock is hydrotreated more severely than is necessary for sulfur and/or nitrogen removal. Preferably, feedstocks according to the invention have a sulfur content of 1 wt % of less, or 0.5 wt % or less, or 0.25 wt % or less. Preferably, feedstocks according to the invention have a nitrogen content of 1000 wppm or less, or 500 wppm or less, or 100 wppm or less. Sulfur and nitrogen contents may be measured by standard ASTM methods D5453 and D4629, respectively.

Hydrotreating

Waxy feedstocks typically contain sulfur and/or nitrogen contaminants in an amount unacceptable for lube oils. Conventionally, if a waxy feedstock contains unacceptable amounts of sulfur and/or nitrogen contaminants, such a feedstock would be contacted with a hydrotreating catalyst under conditions suitable to remove at least an effective amount of the sulfur and/or nitrogen contaminants to produce a hydrotreated feedstock. By "effective amount' is meant removal of at least that amount of nitrogen and sulfur to reach an acceptable sulfur and/or nitrogen level for lube oils.

Conventionally, hydrotreatment can also be used to improve the VI of the lube oil that will eventually be produced from a feedstock. A more severe hydrotreatment will generally result in a lube oil with a higher VI. However, more severe hydrotreatment is also typically results in substantial yield loss after the dewaxing step used to form the lube oil. Due to the impact of the additional yield loss, hydrotreatment beyond the amount needed to remove an effective amount of sulfur and/or nitrogen is typically avoided.

The claimed invention provides a process where the typical inverse correlation between yield and VI is avoided for the overall process. Although the severe hydrotreatment step intentionally reduces the possible yield in a first step, the resulting hydrotreated feed is more suitable for use in the subsequent dewaxing step. As a result, the overall yield after the catalytic dewaxing step is improved.

Hydrotreating catalysts suitable for use herein are those containing at least one Group VIII metal, and preferably at least one Group VIII metal, including mixtures thereof. Preferred metals include Ni, W, Mo, Co and mixtures thereof. These metals or mixtures of metals are typically present as oxides or sulfides on refractory metal oxide supports. The mixture of metals may also be present as bulk metal catalysts wherein the amount of metal is 30 wt. % or greater, based on catalyst. Preferred catalysts include catalysts having nickel, nickel and molybdenum, cobalt and molybdenum, or nickel and tungsten supported on a metal oxide support.

Non-limiting examples of suitable metal oxide supports include silica, alumina, silica-alumina, titania or mixtures thereof. Preferred is alumina. Preferred aluminas are porous aluminas such as gamma or eta alumina. The acidity of metal oxide supports can be controlled by adding promoters and/or dopants, or by controlling the nature of the metal oxide support, e.g., by controlling the amount of silica incorporated into a silica-alumina support. Non-limiting examples of promoters and/or dopants suitable for use herein include halogen (especially fluorine), phosphorus, boron, yttria, rare-earth oxides and magnesia. Promoters such as halogens generally increase the acidity of metal oxide supports while mildly basic dopants such as yttria or magnesia tend to decrease the acidity of such supports.

Bulk catalysts provide an alternative to supported catalysts. It should be noted that bulk catalysts do not include a support material, and the metals are not present as an oxide or sulfide but as the metal itself. These catalysts typically include metals within the range described above in relation to the bulk catalyst as well as at least one extrusion agent.

The amount of metals for supported hydrotreating catalysts, either individually or in mixtures, ranges from about 0.5 to about 35 wt. %, based on catalyst. In the case of preferred mixtures of Group VI and Group VIII metals, the Group VIII metals are present in amounts of from about 0.5 to about 5 wt. %, based on catalyst and the Group VI metals are present in amounts of from about 5 to about 30 wt. %. The amounts of metals may be measured by atomic absorption spectroscopy, inductively coupled plasma-atomic emission spectrometry or other methods specified by ASTM for individual metals.

In an embodiment, effective hydrotreating conditions involve temperatures in the range 280° C. to 400° C., preferably 300° C. to 380° C. at pressures in the range of 1480 to 20786 kPa (200 to 3000 psig), preferably 2859 to 13891 kPa (400 to 2000 psig), a space velocity of from 0.1 to 10 LHSV, preferably 0.1 to 5 LHSV, and a hydrogen treat gas rate of from 89 to 1780 $m^3/m^3$ (500 to 10000 scf/B), preferably 178 to 890 $m^3/m^3$ (1000 to 5000 scf/B).

Hydrotreating will reduce the amount of nitrogen and sulfur contaminants in the waxy feedstock by converting these contaminants to ammonia and hydrogen sulfide, respectively. These gaseous contaminants may be separated from the hydrotreated feedstock using conventional techniques such as strippers, knock-out drums and the like. In the alternative, if the hydrotreated effluent from the hydrotreater contains amounts of contaminants that will not interfere with a subsequent dewaxing or hydrofinishing stage, the entire gaseous and liquid effluent from the hydrotreater may be sent to the first dewaxing stage.

The hydrotreating reaction stage can be comprised of one or more fixed bed reactors or reaction zones within a single reactor each of which can comprise one or more catalyst beds of the same, or different, hydrotreating catalyst. Although other types of catalyst beds can be used, fixed beds are preferred. Such other types of catalyst beds suitable for use herein include fluidized beds, ebullating beds, slurry beds, and moving beds. Interstage cooling or heating between reactors or reaction zones, or between catalyst beds in the same reactor or reaction zone, can be employed since the desulfurization reaction is generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained.

Dewaxing

The dewaxing catalyst may be either crystalline or amorphous, so long as the dewaxing catalyst performs dewaxing preferentially by isomerization rather than cracking. Crystalline materials are molecular sieves that contain at least one 10 or 12 ring channel and may be based on aluminosilicates (zeolites), or may be based on aluminophosphates. Preferably, the molecular sieve has at least one 10 ring channel. More preferably, the catalyst is a unidimensional 10-member ring molecular sieve. Examples of suitable zeolites include ZSM-22, ZSM-23, ZSM-35, ZSM-48, ZSM-57, ferrierite, EU-1, NU-87, ITQ-13 and MCM-71. Examples of aluminophosphates containing at least one 10 ring channel include SAPO-11 and SAPO-41. Preferred isomerizing catalysts include ZSM-48, ZSM-22, ZSM-23, ZSM-12, and ZSM-35. As used herein, ZSM-48 includes EU-2, EU-11 and ZBM-30 which are structurally equivalent to ZSM-48. The molecular sieves are preferably in the hydrogen form. Reduction can occur in situ during the dewaxing step itself or can occur ex situ in another vessel.

The dewaxing catalysts are bifunctional, i.e., they are loaded with a metal hydrogenation component, which is at least one Group 6 metal, at least one Group 8-10 metal, or mixtures thereof. Preferred metals are Groups 9-10 metals. These metals are loaded at the rate of 0.1 to 30 wt. %, based on catalyst. Catalyst preparation and metal loading methods are described for example in U.S. Pat. No. 6,294,077, and include for example ion exchange and impregnation using decomposable metal salts. Metal dispersion techniques and catalyst particle size control are described in U.S. Pat. No. 5,282,958. Catalysts with small particle size and well dispersed metal are preferred. The molecular sieves are typically composited with binder materials that are resistant to high temperatures and may be employed under dewaxing conditions to form a finished dewaxing catalyst or may be binderless (self-bound). The binder materials are usually inorganic oxides such as silica, alumina, silica-aluminas, binary combinations of silicas with other metal oxides such as titania, magnesia, thoria, zirconia and the like and tertiary combinations of these oxides such as silica-alumina-thoria and silica-alumina magnesia. The amount of molecular sieve in the finished dewaxing catalyst is from 10 to 100, preferably 35 to 100 wt. %, based on catalyst. Such catalysts are formed by methods such spray drying, extrusion and the like. The dewaxing catalyst may be used in the sulfided or unsulfided form, and is preferably in the sulfided form.

Dewaxing conditions include temperatures of from 200-500° C., preferably 250 to 400° C., still more preferably 275 to 350° C., pressures of from 790 to 20786 kPa (100 to 3000 psig), preferably 1480 to 17339 kPa (200 to 2500 psig), liquid hourly space velocities of from 0.1 to 10 $hr.^{-1}$, preferably 0.1 to 5 $hr^{-1}$ and hydrogen treat gas rates from 45 to 1780 $m^3/m^3$ (250 to 10000 scf/B), preferably 89 to 890 $m^3/m^3$ (500 to 5000 scf/B).

In an embodiment, the dewaxed product, with or without fractionation, can be conducted to a hydrofinishing zone. Hydrofinishing is a form of mild hydrotreating directed to saturating any lube range olefins and residual aromatics as well as to removing at least a portion of any remaining heteroatoms and color bodies. The post dewaxing hydrofinishing is usually carried out in cascade with the dewaxing step. Generally hydrofinishing will be carried out at temperatures from about 150° C. to 350° C., preferably 180° C. to 250° C. Total pressures are typically from 2859 to 20786 kPa (about 400 to 3000 psig). Liquid hourly space velocity is typically from 0.1 to 5 $hr.^{-1}$, preferably 0.5 to 3 hr.: and hydrogen treat gas rates of from 44.5 to 1780 $m^3/m^3$ (250 to 10,000 scf/B).

Hydrofinishing catalysts are those containing Group VI metals, Group VIII metals, and mixtures thereof. Preferred metals include at least one noble metal having a strong hydrogenation function, especially platinum, palladium and mixtures thereof. The mixture of metals may also be present as bulk (not supported) metal catalysts wherein the amount of metal is 30 wt. % or greater based on catalyst.

Any suitable hydrofinishing catalyst may be used, such as an amorphous substrate with a Group VI and/or a Group VIII metal. Alternatively, a zeolite can be included in the substrate, such as ZSM-48 or ZSM-35. It is preferred that the hydrofinishing catalyst be a supported catalyst. Suitable metal oxide supports include low acidic oxides such as silica, alumina, silica-aluminas or titania, preferably alumina. The preferred hydrofinishing catalysts for aromatics saturation will comprise at least one metal having relatively strong hydrogenation function on a porous support. Typical support materials include amorphous or crystalline oxide materials such as alumina, silica, and silica-alumina. The metal content of the catalyst can be as high as about 20 weight percent for non-noble metals. Noble metals are usually present in amounts no greater than about 1 wt. %. A preferred hydrofinishing catalyst is a mesoporous material belonging to the M41S class or family of catalysts. The M41S family of catalysts are mesoporous materials having high silica contents whose preparation is further described in J. Amer. Chem. Soc., 1992, 114, 10834. Examples included MCM-41, MCM-48 and MCM-50. Mesoporous refers to catalysts having pore sizes from 15 to 100 Angstroms. A preferred member of this class is MCM-41 whose preparation is described in U.S. Pat. No. 5,098,684. MCM-41 is an inorganic, porous, non-layered phase having a hexagonal arrangement of uniformly-sized pores. The physical structure of MCM-41 is like a bundle of straws wherein the opening of the straws (the cell diameter of the pores) ranges from 15 to 100 Angstroms. MCM-48 has a cubic symmetry and is described for example is U.S. Pat. No. 5,198,203 whereas MCM-50 has a lamellar structure. MCM-41 can be made with different size pore openings in the mesoporous range. The mesoporous materials may bear a metal hydrogenation component, which is at least one Group VIII metal. Preferred are Group VIII noble metals, most preferably Pt, Pd or mixtures thereof.

The following examples will illustrate the improved effectiveness of the present invention, but are not meant to limit the present invention in any fashion.

EXAMPLE 1

Production of a high viscosity base oil begins by selecting a suitable feed, such as a feed with greater than 15 wt % or greater than 20 wt % oil in wax. A typical high wax content feed containing oil may contain sulfur, nitrogen, aromatics, or other contaminates such as olefins that would hinder the wax isomerization process. The feed is hydrotreated in a controlled manner to remove sulfur, nitrogen, aromatics, and other contaminates and to severely hydrotreat the high wax content feed to improve the feed properties before wax isomerization. The higher conversion in the hydrotreater, greater than necessary to convert the sulfur and nitrogen to less than 50 ppmw S and 1 ppmw N, allows for the overall improvement in yield and low temperature properties when used in combination with a catalytic isomerization step. The highly hydrotreated feed stock when isomerized produces a higher viscosity index lube base oil as compared to a feed stock mildly hydrotreated just to remove sulfur and nitrogen contaminates.

The high severity hydrotreating process can use a nickel molybdenum, cobalt molybdenum, nickel, nickel tungsten, or other active hydrotreating or highly active hydrofinishing catalyst. Without being bound by any particular theory, it is believed that the high severity hydrotreating process de-alkylates oil molecules (believed to be a key mechanism of VI upgrade) and may even partially isomerizes the paraffins as reflected in increased oil in wax after the severe hydrotreating.

Table 2 shows how increasing hydrotreating (HDT) conversion increases viscosity index of a hydrotreated solvent dewaxed oil. Prior to hydrotreatment, the feed corresponded to the feed shown in Table 1. The feed was hydrotreated using a commercially available NiMo supported catalyst. Table 2 shows that VI upgrade with conversion is steeper at conversion <6% than >6% conversion. For instance, 6% conversion achieved 25 VI upgrade of the hydrotreated oil whereas additional 6% conversion achieved only 9 more VI upgrade. Typical distillate hydrocracking and raffinate hydrotreating require much higher conversion to achieve similar VI upgrade as in this slack wax hydrotreating. The benefit of moderate conversion (6%) to achieve a high oil VI upgrade is also shown in the minimal distillation change especially in the backend thus retaining most of high viscosity materials (see FIG. 1).

Note that FIG. 1 also highlights the difference between the severe hydrotreating according to the invention and a mild hydrocracking process. In a hydrocracking process, the change in the distillation curve would be more pronounced throughout the breadth of the curve. By contrast, the change in the distillation curve in FIG. 1, which was subjected to severe hydrotreating, is more heavily focused on the lower boiling components of the feed.

As illustrated later, the higher HDT oil VI also increases the isomerized product VI, and there seems to be an optimal HDT conversion to achieve both high VI and yield of the final lube product.

TABLE 2

Viscosity Index (VI) of Hydrotreated Oil VI as Function of Conversion

| HDT 370° C. + Conversion (wt %) | HDT Solvent Dewaxed Oil VI | Solvent Dewaxed Oil Pour Point (° C.) |
|---|---|---|
| 0.4 | 104.6 | −14 |
| 2.3 | 111.7 | −12 |
| 6.1 | 128.1 | −12 |
| 11.8 | 136.9 | −14 |

After hydrotreatment, the feed is catalytically dewaxed. For example, a typical wax isomerization process using a catalyst containing a noble metal (typically Pt) supported on a zeolite can be used at low or high pressure in the presence of hydrogen and high temperature to isomerize the paraffins and saturate unsaturated compounds in the feed stock. This results in higher viscosity, low pour point, low wax content lube base oils meeting or exceeding group III lube base oil specifications for the blending of high quality lubricants.

Figure 2:
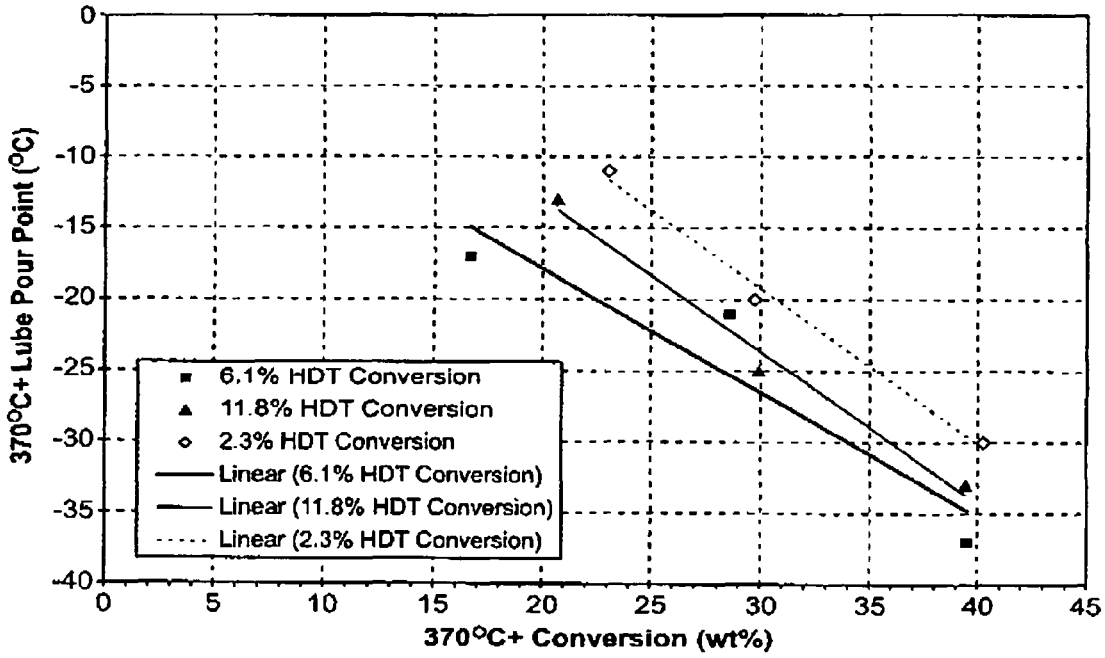
FIG. 2 shows low temperature properties and yield for base oils produced according to various processes.

Table 3 shows lube product VI and yield from a wax isomerization process for the bottom three hydrotreated feeds shown in Table 2. The feeds were dewaxed to the stated pour point over a supported ZSM-48 catalyst that included 0.6 wt % Pt. FIG. 2 shows the 370° C.+conversion required to dewax the various HDT-product to different lube pour point. The figure shows that the 6% HDT conversion feed has best wax isomerization selectivity as reflected by lowest conversion required to achieve a given lube pour point. Along with this figure, Table 3 shows that although higher HDT conversion continuously increases final lube product VI, the lube yield does not continuously increase. Table 3 shows both the raw measured values for each dewaxed feed, and the values when corrected to a pour point of −23° C. As shown in the table, severe hydrotreatment to achieve a conversion of 6.1 wt % in the hydrotreatment step significantly increases the yield from the dewaxing step. At 11.8 wt % conversion, the yield from the dewaxing step is still higher than for the 2.3 wt % conversion case, but the difference in dewaxing yield is less than the difference in the initial conversion.

TABLE 3

Wax Isomeration Product VI and Yields for Different Severity HDT Feeds

| HDT 370° C.+ Conversion (wt %) | Measured Lube KV100 (cSt) | Measured Lube Pour Point (° C.) | Measured Lube VI | Estimated Lube VI Corrected to −23° C. Pour Point | Measured Wt % Yield across Wax Isomerization | Estimated Wt % Yield across Wax Isomerization Corrected to −23° C. Pour Point |
|---|---|---|---|---|---|---|
| 2.3 | 4.04 | −21 | 142 | 141 | 35 | 33 |
| 6.1 | 4.04 | −31 | 138 | 142 | 34 | 42 |
| 11.8 | 4.00 | −33 | 141 | 145 | 25.2 | 35.2 |

Note that the products reported in Table 3 also underwent a hydrofinishing step prior to measurement of pour point and VI.

EXAMPLE 2

Yield Benefit

In various embodiments, another aspect of the invention is an expected ability to achieve higher yields of desirable base oils by using feeds with oil contents that are conventionally believed to be less desirable.

Conventionally, a process for producing a high viscosity 4 cSt base oil would involve starting with a feed containing 8-10 wt % oil in wax. This feed would be hydrotreated to a conversion level sufficient to remove sulfur and nitrogen. Typically, this would require less than 3% conversion, such as between 0.5 and 2.5% conversion. The hydrotreated feed would then be dewaxed to a sufficient pour point (such as −18° C.) provide a base oil. The yield across the combination of the hydrotreating and dewaxing steps would be in the range of 30-40%.

Using process conditions according to the invention, it is believed a higher overall yield can be achieved using a feed that is conventionally considered as unsuitable for forming a 4 cSt high viscosity base oil. In fact, the yield is believed to increase as the oil in wax increases in the feed under the method of the invention. This additional benefit of increased yield from increased oil in wax should continue until the feed contains enough oil in wax that it is no longer feasible to generate the desired VI. At that point, further oil in wax is believed to cause a sharp drop in yield under the inventive process.

For example, when making a 4 cSt high viscosity base oil according to the invention, a feed with higher oil in wax can be used, such as a feed with at least 10% oil in wax, or at least 15%, or at least 20%, or at least 25%, or at least 30%. The severity of the hydrotreating can vary according to the amount of oil in the wax. Higher yields are believed to be possible using combinations of both higher severity and higher oil in wax. For example, a feed with at least 25% oil in wax, or at least 30% oil in wax, could be hydrotreated at a higher severity, such as at least 10%, or at least 12%, or even up to 15%. After the following dewaxing step, it is believed that this more severe hydrotreatment of a higher oil in wax feed could allow for yields up to 45% across the combination of the hydrotreatment and dewaxing steps. More generally, by using the higher oil in wax content feeds according to the invention, it is believed that higher yields can be achieved relative to conventional methods, such as above 35% yield, or above 40%, or above 45%.

Similar correlations to the above should also apply for other grades of oil, such as 5 cSt base oil, or 6 cSt base oil. Thus, by using a feed with at least 15% oil in wax, or at least 20%, or at least 25%, or at least 30%, higher yields should be possible for making 5 cSt base oils. By using a feed with at least 20% oil in wax, or at least 25%, or at least 30%, or at least 35%, higher yields should be possible for making 6 cSt base oils.

What is claimed is:

1. A method for producing a high viscosity base oil having a VI of at least 140 and a viscosity of 4 cSt to 5 cSt at 100° C., comprising:

hydrotreating a feedstock containing at least 15 wt % oil in wax under effective conditions for conversion of 4-15 wt % of the feed to products boiling below 370° C.; and catalytically dewaxing the hydrotreated feed under effective conditions to produce a base oil with a VI of at least 140, a pour point of −18° C. or less, and a viscosity at 100° C. that is greater than the viscosity at 100° C. of the feedstock, wherein the yield of base oil across the combination of the hydrotreating and the catalytic dewaxing is at least about 35 wt % relative to the feedstock.

2. A method for producing a high viscosity base oil having a VI of at least 140 and a viscosity of 5 cSt to 6 cSt at 100° C., comprising:

hydrotreating a feedstock containing at least 20 wt % oil in wax under effective conditions for conversion of 4-15 wt % of the feed to products boiling below 370° C.; and catalytically dewaxing the hydrotreated feed under effective conditions to produce a base oil with a VI of at least 140, a pour point of −18° C. or less, and a viscosity at 100° C. that is greater than the viscosity at 100° C. of the feedstock, wherein the yield of base oil across the combination of the hydrotreating and the catalytic dewaxing is at least about 35 wt % relative to the feedstock.

3. A method for producing a high viscosity base oil having a VI of at least 140 and a viscosity of at least 6 cSt at 100° C., comprising:

hydrotreating a feedstock containing at least 25 wt % oil in wax under effective conditions for conversion of 4-15 wt % of the feed to products boiling below 370° C.; and catalytically dewaxing the hydrotreated feed under effective conditions to produce a base oil with a VI of at least 140 and a pour point of −18° C. or less.

4. The method of any of claims 1-3, wherein the conversion in the hydrotreating step is 4-12 wt %.

5. The method of any of claims 1-3, wherein the conversion in the hydrotreating step is 6-12 wt %.

6. The method of any of claims 1-3, wherein the conversion in the hydrotreating step is 8-12 wt %.

7. The method of claim 1, wherein the process further comprises a hydrofinishing step.

8. The method of claim 3, wherein the feedstock contains at least 30% wt % oil in wax.

* * * * *